US009976367B2

(12) United States Patent
Dykstra et al.

(10) Patent No.: US 9,976,367 B2
(45) Date of Patent: May 22, 2018

(54) CABLE SYSTEM CONTROL USING FLUID FLOW FOR APPLYING LOCOMOTIVE FORCE

(71) Applicant: HALLIBURTON ENERGY SERVICES, INC., Houston, TX (US)

(72) Inventors: Jason D. Dykstra, Carrollton, TX (US); Mehdi Mazrooee, Dallas, TX (US); Daniel Viassolo, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 301 days.

(21) Appl. No.: 14/888,812

(22) PCT Filed: Jun. 17, 2013

(86) PCT No.: PCT/US2013/046090
§ 371 (c)(1),
(2) Date: Nov. 3, 2015

(87) PCT Pub. No.: WO2014/204428
PCT Pub. Date: Dec. 24, 2014

(65) Prior Publication Data
US 2016/0076325 A1 Mar. 17, 2016

(51) Int. Cl.
*E21B 23/08* (2006.01)
*E21B 23/14* (2006.01)
(Continued)

(52) U.S. Cl.
CPC ..... *E21B 23/08* (2013.01); *E21B 23/14* (2013.01); *E21B 47/04* (2013.01); *E21B 47/09* (2013.01)

(58) Field of Classification Search
CPC ..... E21B 23/08; E21B 23/14; E21B 47/04; E21B 47/09
See application file for complete search history.

(56) References Cited

U.S. PATENT DOCUMENTS 3,027,649 A * 4/1962 Sloan ..... E21B 47/04 324/206
4,252,190 A 2/1981 Jageler et al.
(Continued)

FOREIGN PATENT DOCUMENTS

EP 0518371 A3 * 11/1993 ..... E21B 17/003
WO 2003/069119 A1 8/2003
(Continued)

OTHER PUBLICATIONS

Diamond Offshore, Offshore Drilling Basics, available at http://www.diamondoffshore.com/offshore-drilling-basics (last visited Oct. 30, 2015), 3 pages.
(Continued)

*Primary Examiner* — James G Sayre
(74) *Attorney, Agent, or Firm* — Scott Richardson; Baker Botts L.L.P.

(57) ABSTRACT

Controlling cable (30) tension and tool (34) position in a well (16) may include controlling either or both of tool position and cable tension independently by regulating reel (335) angle and flow rate of a fluid pumped over the tool. Thus, despite physical interdependency of tool position and cable tension, the tool may be controlled such that its position is changed while cable tension remains constant, or its position is held constant while cable tension is changed. In addition, actual downhole tool position, cable tension, and other actual values may be estimated using an observer.

27 Claims, 6 Drawing Sheets

(51) Int. Cl.
*E21B 47/09* (2012.01)
*E21B 47/04* (2012.01)

(56) References Cited

U.S. PATENT DOCUMENTS 4,940,094 A * 7/1990 Lessi ..... E21B 23/08 166/154
5,138,876 A 8/1992 Moore et al.
5,351,531 A * 10/1994 Kerr ..... E21B 47/04 324/206
6,378,627 B1 4/2002 Tubel et al.
6,820,702 B2 11/2004 Niedermayr et al.
2002/0139527 A1* 10/2002 Song ..... E21B 47/022 166/255.1
2008/0314579 A1* 12/2008 Den Boer ..... E21B 19/002 166/70
2012/0085531 A1* 4/2012 Leising ..... E21B 47/00 166/77.2
2015/0013975 A1* 1/2015 McColpin ..... E21B 47/09 166/255.1
2015/0330172 A1* 11/2015 Allmaras ..... E21B 23/08 166/250.01

FOREIGN PATENT DOCUMENTS

WO 2004/114487 A1 12/2004
WO 2012021126 A1 2/2012

OTHER PUBLICATIONS

International Search Report and Written Opinion issued in related PCT Application No. PCT/US2013/046090 dated Mar. 18, 2014, 13 pages.
Office Action issued in related Canadian Application No. 2,911,369, dated Sep. 15, 2016 (4 pages).

* cited by examiner

CABLE SYSTEM CONTROL USING FLUID FLOW FOR APPLYING LOCOMOTIVE FORCE

CROSS-REFERENCE TO RELATED APPLICATION

The present application is a U.S. National Stage Application of International Application No. PCT/US2013/046090 filed Jun. 17, 2013, which is incorporated herein by reference in its entirety for all purposes.

BACKGROUND

The present disclosure relates generally to subterranean drilling operations and, more particularly, the present disclosure relates to methods and systems for controlling a wireline, slickline, coiled tubing, or like cable system.

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

When performing subterranean operations, it is often desirable to use various downhole tools, such as tools for monitoring the characteristics of the formation being developed as well as the status of drilling fluids and equipment (such as casing, drill bit, etc.), and tools for carrying out various operations such as maintenance on downhole equipment. Such downhole tools are often connected to a cable, such as a wireline or slickline, and lowered into the well in what are typically called wireline or slickline operations.

Positioning of a tool in a well may in some circumstances be achieved by gravity alone—that is, by simply unreeling a desired amount of cable such that the cable extends, lowering the tool to a target location within the well. While such a control system could work adequately in some wells, gravity alone may not overcome the frictional forces on a tool in, e.g., narrow and/or deviated wells. Moreover, gravity will provide little, if any, help in positioning a tool in horizontal or substantially horizontal sections of a well.

FIGURES

Some specific exemplary embodiments of the disclosure may be understood by referring, in part, to the following description and the accompanying drawings.

FIG. 1 is a diagram illustrating a wireline environment, incorporating aspects of the present disclosure.

FIGS. 2A-B are diagrams illustrating stylized force diagrams on a tool and a reel, according to aspects of the present disclosure.

Figure 5A:
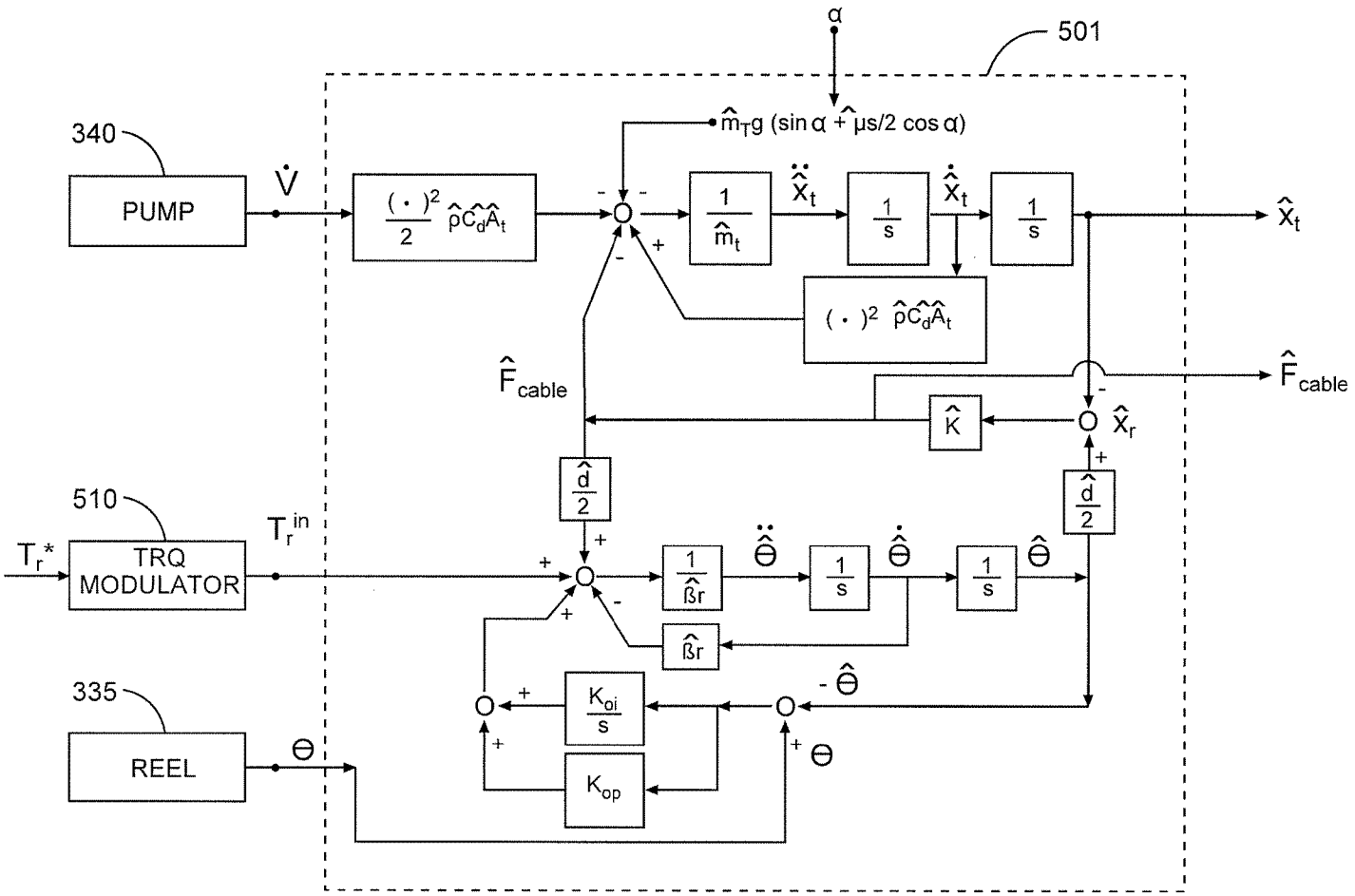
Figure 5B:
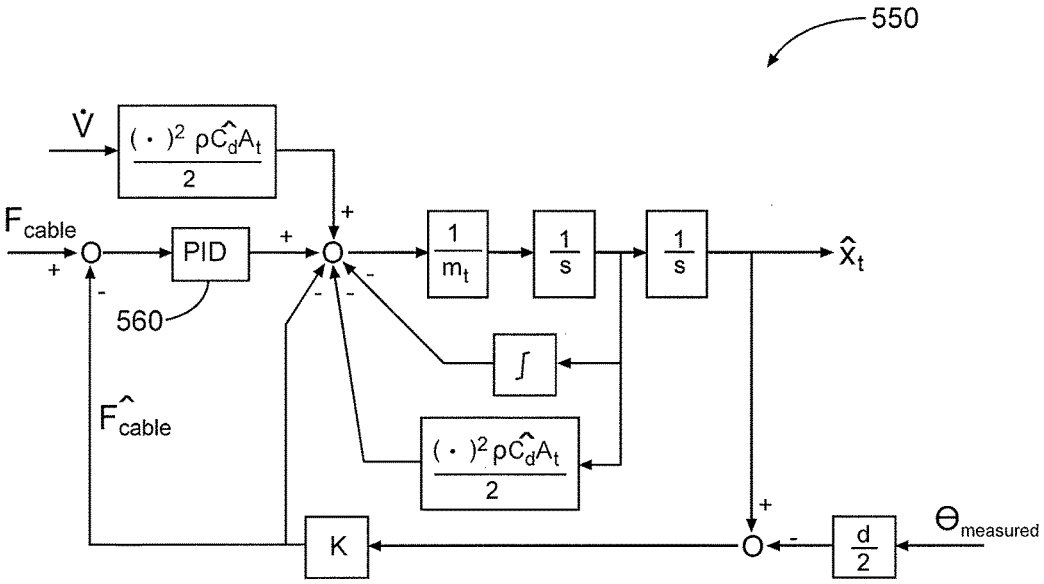

FIGS. 5A-B are diagrams illustrating example observers, incorporating aspects of the present disclosure.

Figure 6:
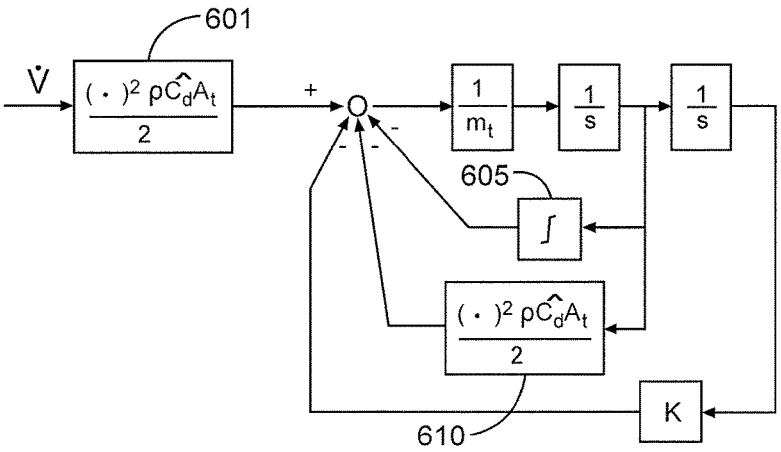

FIG. 6 is a diagram illustrating an exemplary block diagram for calibration of a drag coefficient, incorporating aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

The present disclosure relates generally to subterranean drilling operations and, more particularly, the present disclosure relates to methods and systems for controlling a wireline, slickline, coiled tubing, or like system.

The present disclosure in some embodiments provides methods and systems for controlling the position of a tool in a well using a cable reel coupled to the tool by a cable and a fluid pumped or otherwise caused to flow around the tool. The methods and systems provided herein are suitable for control of any system including a reel coupled to a tool by a cable, and/or a cable coupled to a tool and to a cable reel. Examples of a cable include a wireline, slickline, coiled tubing, or the like coupled to a tool and which may be used for, among other things, moving the tool within a well.

Figure 1:
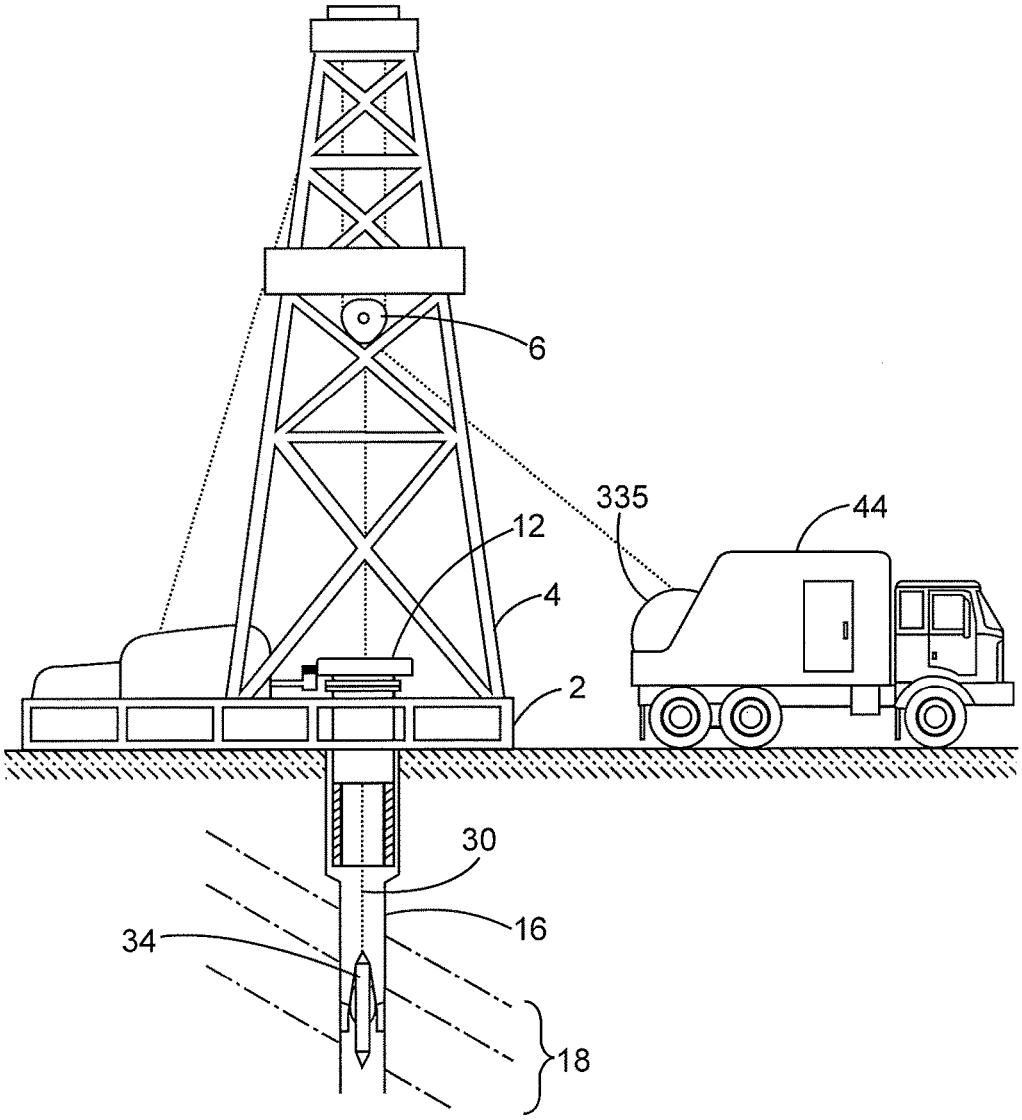

FIG. 1 depicts an example of a cable system set-up in a well. In the example shown in FIG. 1, the cable 30 may be a wireline, slickline, or coiled tubing. A drilling platform 2 supports a derrick 4 having a traveling block 6 for raising and lowering a cable 30. The cable 30 passes through a rotary table 12 into the borehole 16 of the well, which traverses one or more subterranean formations 18. The cable 30 at one end is anchored to a reel 335 housed in a service truck (or other structure) 44, and at the other end is coupled to a tool 34 in the borehole 16. The reel 335 may be mechanically, hydraulically, or otherwise driven in the usual manner to raise and lower the tool 34 up or down the borehole 16, using the force of gravity acting on the tool 34 to accomplish movement in a downhole direction (that is, through the borehole 16 away from the surface of the well), while reeling the cable 30 in to accomplish movement of the tool 34 toward the surface of the well.

In addition, pumping or otherwise introducing fluid (not shown in FIG. 1) downhole such that it passes over and around the tool 34 may result in movement of the tool due to the force of drag that the fluid exerts upon the tool 34. Such a pumped fluid may, in some embodiments, allow for movement of the tool 34 even when gravity alone would not provide for accurate positioning solely by unwinding the cable 30 using the reel 335. Positioning by fluid pumping may be useful in, e.g., tight wells (that is, wells having diameter such that there is little annular space between the tool and casing or between the tool and the borehole wall). Positioning by fluid pumping may also be useful in deviated, and/or substantially horizontal wells, or in any situation where gravity alone fails to allow for accurate positioning of a tool by way of unwinding its reel so as to extend the cable coupled to the tool. Furthermore, it will be appreciated by one of ordinary skill in the art with the benefit of this disclosure that a fluid need not necessarily be pumped; a fluid may be poured or otherwise passed over the tool in any manner sufficient to exert drag or other force upon the tool so as to cause locomotion of the tool. In some embodiments, a pump or other means of fluid delivery may be located at or near the surface of the well, and it may be capable of delivering the fluid downhole and over the tool. In some embodiments, more than one pump may be used for fluid delivery.

Figure 2A:
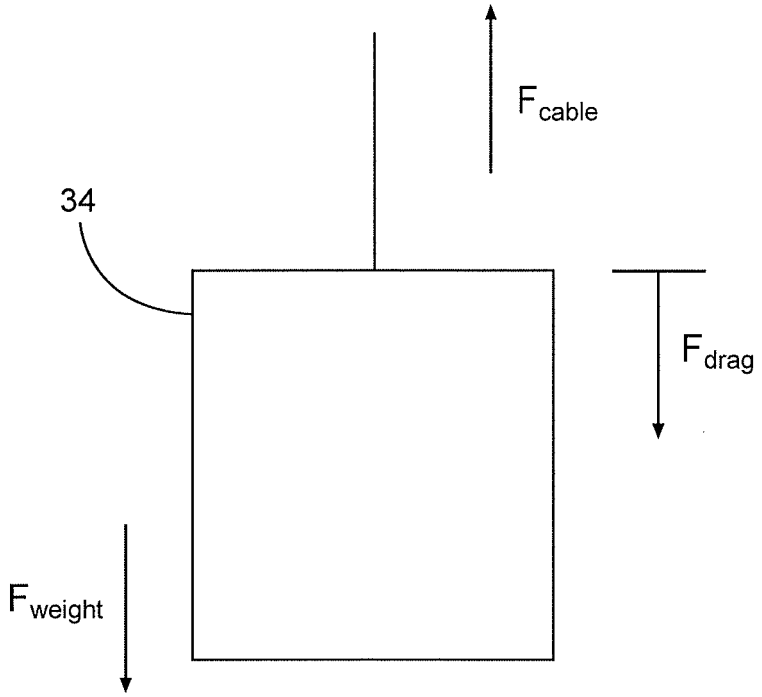

Thus, in some embodiments, either or both of fluid flow and reel winding (and/or unwinding) may be used to change the downhole location of the tool 34, or $x_t$. In addition, either or both of reeling and fluid flow may affect the tension in the cable 30 or other cable ($F_{cable}$. FIG. 2A is a simplified force diagram imposed on a stylized representation of the tool 34 coupled to the cable 30 (or which may be coupled to another kind of cable). In FIG. 2A, $F_{weight}$ signifies gravitational force acting on the tool 34 proportional to the tool's mass; $F_{cable}$ signifies force acting on the tool 34 due to tension in the cable 30, and $F_{drag}$ signifies drag force on the tool 34 resulting from a fluid passed over the tool 34. $F_{cable}$ acts on the tool 34 in a direction toward the surface of the well, while $F_{weight}$ and $F_{drag}$ act in a downhole direction on the tool 34. It will be appreciated by one of ordinary skill in the art that a direction toward the surface of a well and a downhole direction may not necessarily be upward and downward, particularly where a well is in whole or in part deviated, horizontal or substantially horizontal. In the steady state condition, $F_{cable}=F_{weight}$ $F_{drag}$. In general, then, increasing fluid flow rate (thereby increasing $F_{drag}$) may result in movement of the tool downhole due to extension of the cable on its reel in response to the increased load (so long as $F_{drag}$ increases sufficiently to overcome any opposing force of friction and/or stiction due to, e.g., the borehole 16 or casing surrounding or otherwise in contact with the tool 34). And, reeling the tool 34 so as to change its location (e.g., by moving it toward the surface) would result in increased cable tension due to increased drag by the relative motion of the tool 34 in the flowing fluid. Thus, it can be seen that tool position $x_t$ and cable tension $F_{cable}$ may be interdependent; that is, using either or both of reel angle and fluid flow to move the tool's position also may affect cable tension $F_{cable}$, and vice-versa.

Accordingly, in some embodiments, the present disclosure includes systems and methods for controlling the reel and fluid flow such that the controlled variables (tool position $x_t$ and cable tension $F_{cable}$) act as if each variable were independent of the other. In other words, in some embodiments, either or both of the reel and fluid flow may be controlled such that the tool location and cable tension may be changed independently of each other, that is, (i) the tool position may change while the cable tension remains substantially constant; and/or (ii) the cable tension may change while the tool position remains substantially constant.

In some such embodiments, reel control may be in terms of control of the reel angle θ, i.e., the rotational distance the reel is turned so as to reel or unreel the cable, and fluid flow control may be in terms of the volumetric flow rate $\dot{V}$ of the fluid into the well (e.g., the pump rate, or the rate at which the fluid is poured or otherwise introduced into the well). In other words, the manipulated variables of a control system or method may include reel angle θ and volumetric flow rate $\dot{V}$. In embodiments wherein the fluid is pumped, volumetric flow rate $\dot{V}$ may more specifically refer to pump rate of one or more pumps pumping fluid into the well (and such a pump rate may either be individual—that is, on a per-pump basis, or collective—that is, a pump rate achieved by all pumps combined).

Furthermore, in some embodiments (e.g., where the reel is of fixed diameter d), changes in reel angle may be proportional to reel angular velocity, which in turn is proportional to line speed of the cable. In addition, the reel is rotated (or held stationary) by application of torque to the reel. Accordingly, the reel control of some embodiments may alternatively be referred to as, or expressed in terms of, any one or more of reel angle θ, reel angular velocity, torque input to the reel, and/or line speed of the cable. Thus, where reel angle θ is referred to herein, it will be apparent to one of ordinary skill in the art with the benefit of this disclosure that reel angular velocity, torque, and/or line speed of the cable may be substituted for reel angle θ with minimal, if any, modification, due to the relationship of those parameters.

A control system or method according to the present disclosure may be capable of regulating either or both of the reel and fluid flow. "Regulating" as used herein includes any one or more of activating, deactivating, or otherwise controlling, modifying, or maintaining. In some embodiments, regulation may take place at least in part by way of one or more actuators or other like devices for regulating reel and/or fluid flow. Such actuators or like devices may be coupled to either the reel or a pump (or other mechanism for inducing fluid flow such as, e.g., a valve) in such a manner as to affect their operation, as is known in the art. In some embodiments, such regulation may take place automatically, or otherwise take place without the necessity of human intervention. For example, in certain embodiments, computer-readable instructions setting forth the methods or systems disclosed herein may be stored in a computer readable medium accessible to an information handling system. The information handling system may then utilize the instructions provided to perform the systems and methods disclosed herein in a wholly or partially automated fashion. Specifically, in some embodiments, control of either or both of reel and fluid flow may be accomplished by an information handling system communicatively coupled to any one or more of the reel and fluid flow actuators (or other like devices), wherein the information handling system may perform the methods disclosed herein in a wholly or partially automated fashion. For example, executing the instructions may cause one or more processing resources within the information handling system to perform any one or more determinations or calculations described herein, and executing the instructions may further cause the one or more processing resources to issue and/or receive signals (such as control signals) which may be used to regulate either or both of the reel and fluid flow by conventional means, such as, for example, by conversion of signals to a torque, voltage, frequency, hydraulic pressure, or other signal suitable for the type of actuator or like device driving the physical subsystem under control (e.g., pump, valve, reel).

In some embodiments fluid flow rate may be controlled automatically, while the reel need not be controlled entirely automatically (such that the reel may be regulated by, e.g., a wireline unit operator or other cable operator). In other embodiments, the reel may be controlled automatically, while the fluid flow need not be controlled automatically (such that the fluid flow may be controlled by, e.g., a pump unit operator). In other embodiments, both or neither of the reel and fluid flow may be controlled automatically. In embodiments in which either one or both of reel and fluid flow are not controlled automatically (e.g., where an operator controls one or both of reel and fluid flow), the systems and methods of the present disclosure may include outputting (e.g., displaying or otherwise making available for monitoring or viewing) recommended changes to either or both of reel and fluid flow for an operator to effectuate. Displaying may include displaying on a video display of or coupled to an information handling system. In some embodiments, systems and methods of the present disclosure may be capable of outputting signals (such as control signals) to regulate either or both of the reel by way of a reel-control signal to a reel-control device and fluid flow by way of a pump-control signal to a pump-control device. Such signals may be overridden or otherwise ignored in favor of operator control of either or both of the reel and fluid flow.

Figure 2B:
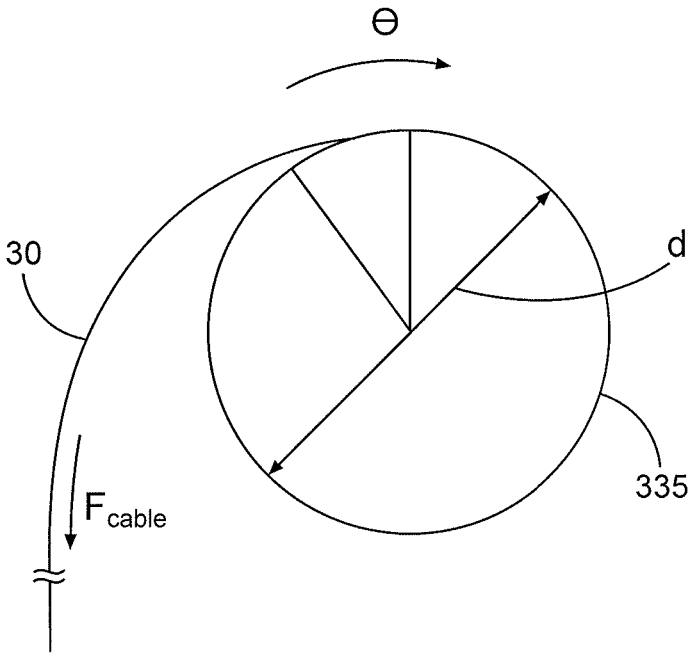

FIG. 2B is a simplified force diagram imposed on a stylized representation of a reel 335 with a diameter of d and a coupled cable 30, showing a sample reel angle θ constituting a partial rotation of the reel in a direction such that it reels the cable in. It will be understood by one of ordinary skill in the art that reel angle θ need not be a partial rotation; it may constitute one or more than one full rotations of the reel (e.g., θ greater than 2π radians, or greater than) 360°. With reference to FIGS. 2A and 2B, expressions for tool position $x_t$ and cable tension $F_{cable}$ may be derived and expressed in terms of fluid volumetric flow rate $\dot{V}$ and reel angle θ. Again, the basic relationship between the various forces acting on the tool 34 ($F_{cable}$, $F_{drag}$, and $F_{weight}$) is:

$$F_{cable}=F_{weight}+F_{drag} \quad \text{(Equation 1)}$$

In embodiments where $F_{drag}$ results from fluid flow over the tool, $F_{drag}$ at any single point of time may be modeled as:

$$F_{drag}=\left(\frac{\dot{V}}{D_p}-\dot{x}_t\right)^2\frac{\rho C_d A_t}{2} \quad \text{(Equation 2)}$$

where Equation 2 is derived from a standard drag equation with velocity u substituted based upon relative motion of the tool through the flowing fluid:

$$u=\left(\frac{\dot{V}}{D_p}-\dot{x}_t\right) \quad \text{(Equation 3)}$$

In Equations 2 and 3, $\dot{V}$ is volumetric flow rate of a fluid flowing downhole over the tool with respect to time t (e.g., $m^3/s$, $ft^3/s$, or other such rate); $D_p$ is diameter of the pipe, casing, borehole, or other channel through which the fluid flows; $\dot{x}_t$ is tool position with respect to time t; ρ is fluid density; $C_d$ is drag coefficient for fluid flow over the tool; and $A_t$ is the cross-sectional area of the tool with respect to fluid flow direction.

Assuming that $F_{weight}$ (weight of the tool, or force of gravity acting on the tool) will be handled by an integrator (e.g., the integrator of a proportional-integral-derivative (PID) controller will factor in the torque to be applied to the reel to counterbalance $F_{weight}$) within the control system or method, it may be disregarded, giving $F_{cable}=F_{drag}$ from Equation 1. In such a case, substitution for $F_{drag}$ via Equation 2 gives:

$$F_{wire} = \left(\frac{\dot{V}}{D_p} - \dot{x}_t\right)^2 \frac{\rho C_d A_t}{2} \quad \text{(Equation 4)}$$

Equation 4 may be expressed in terms of volumetric flow rate $\dot{V}$ according to the following:

$$\dot{V} = D_p\left\{\left(F_{wire}\frac{2}{\rho C_d A_t}\right)^2 + \dot{x}_i\right\} \quad \text{(Equation 5)}$$

In addition, cable tension $F_{cable}$ can be put in terms of reel angle according to:

$$F_{wire} = K\left(\frac{d}{2}\theta - x_i\right) \quad \text{(Equation 6)}$$

where θ is reel angle, d is diameter of the reel, K is spring constant of the cable, $x_t$ is position of the tool at any one given time, and other variables are as previously defined. Rearranging Equation 6 to express in terms of reel angle θ gives:

$$\theta = \frac{2}{d}\left(x_t + \frac{1}{K}F_{wire}\right) \quad \text{(Equation 7)}$$

Thus, Equations 5 and 7, or their equivalents, may be used in some embodiments to treat cable tension $F_{cable}$ and tool position $x_t$ in terms of volumetric flow rate $\dot{V}$ and reel angle θ. In such embodiments, volumetric flow rate $\dot{V}$ and reel angle θ may be used as manipulated variables in a control system or method. In addition, as previously discussed, reel angle θ may be expressed as, converted to, or otherwise put in terms of reel angular velocity and/or line speed.

Figure 3:
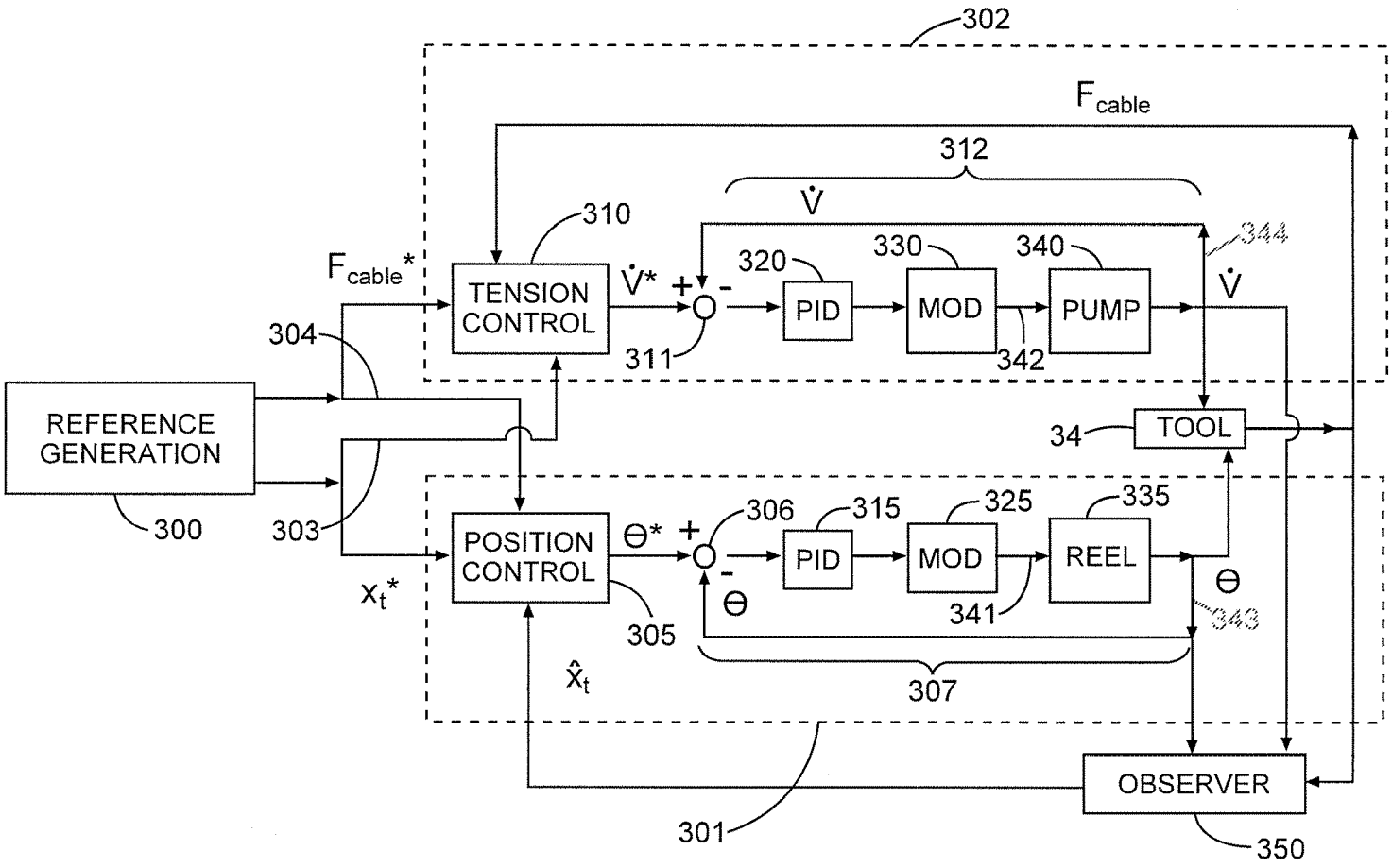
FIG. 3 is a diagram illustrating an example reel and fluid flow control system, according to aspects of the present disclosure.

FIG. 3 is a block diagram of an example control system that may be referenced to describe control techniques according to some embodiments of the present disclosure. Such techniques may be implemented in various embodiments as either or both of a system and a method. In some embodiments, control systems and methods of the present disclosure may include determining either or both of a desired cable tension and a desired tool position. For example, FIG. 3 includes reference generation 300 at which set-points for controlled variables (in FIG. 3, cable tension set-point $F_{cable}$* and tool position set-point $x_t$*) are generated. A desired cable tension and/or tool position, including a set-point, may be determined, calculated, or generated by any suitable means and/or steps. In some embodiments, such set-points may each be a single desired value to achieve and maintain for either of cable tension and tool position. In certain embodiments, each single value may be dynamically updated (for example, in response to an input from an operator, or in response to updated calculation by the reference generation 300). In other embodiments, desired values, including set-points, may be time-dependent profiles. Thus, desired values may be first- or second-order derivatives of either or both of tool position and cable tension. For example, in prescribing a desired tool position vs. time set-point profile, reference generation 300 may include calculating, determining, or generating a desired tool speed (e.g., a first-order derivative of tool position with respect to time). Desired values for either or both of cable tension and tool position may, in some embodiments, be determined based at least in part upon any one or more of the following: actual or estimated cable tension; actual or estimated tool position; any one or more well and/or formation characteristics (such as, e.g., the location downhole of a formation or portion of a formation about which more information may be gathered via the tool 34). As with other features of the present disclosure, reference generation may in some embodiments be carried out by means of an information handling system, which may include software and/or other executable means implemented on a computer-readable medium, and which may include a user interface for input of commands and/or data used to determine desired cable tension and/or tool position.

Systems and methods of some embodiments may also include regulating or otherwise controlling any one or more of reel angle θ and fluid flow rate $\dot{V}$ based at least in part upon both desired cable tension and desired tool position. Such regulation or control may include modifying reel angle θ and fluid flow rate $\dot{V}$. Some embodiments may include calculating or otherwise determining a desired modification to reel angle θ and regulating or otherwise controlling a reel to implement the desired reel angle modification; and/or calculating or otherwise determining a desired modification to fluid flow rate $\dot{V}$ and regulating fluid flow to implement the desired fluid flow modification. The objective of regulation of either or both of reel angle θ and fluid flow rate $\dot{V}$ (either individually, or in combination) may be to achieve the desired cable tension $F_{cable}$, the desired tool position $x_t$, or both. In addition, in some embodiments, either or both of reel angle θ and fluid flow rate $\dot{V}$ may be regulated so as to change only one of cable tension and tool position, without altering the other—that is, regulation of either or both of reel angle and fluid flow rate may result in control of cable tension independent of tool position, or vice-versa. Thus, cable tension may remain constant while the tool position is changed, or tool position may remain constant while cable tension is changed. Similarly, in some embodiments, cable tension may remain substantially equal to a desired cable tension (which may or may not be constant) while the tool position is changed, or tool position remain substantially equal to a desired tool position (which may or may not be constant) while the cable tension is changed.

Because of the interdependence of the controlled variables cable tension and tool position, some embodiments may include disassociating the interdependence of each controlled variable on the other. For example, the embodiment depicted in FIG. 3 includes a reel subsystem 301 and a fluid flow subsystem 302, as well as inputs 303 and 304 for, respectively, cross-inputting set-point $x_t$* to fluid flow subsystem 302 and for cross-inputting set-point $F_{cable}$* to reel subsystem 301. Thus, in this embodiment, each of the two subsystems has as inputs both controlled variable set-points $x_t$* and $F_{cable}$*. In some embodiments, such inputs may be signals. Input 304 may in some embodiments be used to move the reel angle set-point θ* so as to nullify effects on tool position that would otherwise result due to a changed cable tension set-point $F_{cable}$*. Taking the example situation of a set-point cable tension $F_{cable}$* that would result in increasing cable tension by increasing fluid flow rate, input 304 may move the reel angle set-point θ* based upon the set-point cable tension $F_{cable}$* so as to offset the drag force that would result from the anticipated increased fluid flow rate, thereby keeping the tool position constant. Accordingly, in some embodiments, input 304 may include one or more transfer functions or other control means for modifying reel angle set-point $\theta^*$ based upon cable tension set-point $F_{cable}^*$, as shown for example by transfer function 404 in FIG. 4. Likewise, input 303 may include one or more transfer functions or other control means for modifying fluid flow rate set-point $\dot{V}^*$ based upon tool position set-point $x_t^*$, as shown for example by transfer functions 403*a* and 403*b* in FIG. 4. Such means included in input 303 are an example of taking into account tool position set-point $x_t^*$ so as to move fluid flow set-point $\dot{V}^*$ in a manner similar to moving reel angle set-point $\theta^*$ as discussed above with respect to cable tension set-point $F_{cable}^*$.

Systems and methods may also include verifying that modifications (to either or both of reel angle $\theta$ and fluid flow rate $\dot{V}$) are implemented, e.g., by an actuator, reel unit operator, or any other suitable means of regulating the reel 335. Such verification may include verifying the accuracy of regulation, which may include comparing a measured reel angle $\theta$ and/or fluid flow rate $\dot{V}$ to a reel angle set-point $\theta^*$ and/or a fluid flow rate set-point $\dot{V}^*$, respectively. Thus, for example, some embodiments may include verifying that regulation of the reel angle results in a previously calculated or otherwise determined modification to the reel angle. Such verification may be by any suitable means, including comparison between measured and/or estimated actual reel angle $\theta$ to reel angle $\theta$ that would have been expected to result from a calculated or otherwise determined reel angle modification. Likewise, some embodiments may include verifying that regulation of fluid flow rate results in a previously calculated or otherwise determined modification to fluid flow rate. In addition, systems and methods may include measuring, estimating, or otherwise determining actual tool position $x_t$ that results due at least in part to modification to either or both of reel angle $\theta$ and fluid flow rate $\dot{V}$. In some embodiments, this resulting tool position $x_t$ may furthermore form at least part of the basis for a subsequent additional modification to reel angle $\theta$ and/or fluid flow rate $\dot{V}$. Likewise, systems and methods may include measuring, estimating, or otherwise determining actual cable tension $F_{cable}$ that results due at least in part to modification to either or both of reel angle $\theta$ and fluid flow rate $\dot{V}$, and this resulting cable tension $F_{cable}$ may furthermore form at least part of the basis for a subsequent additional modification to reel angle $\theta$ and/or fluid flow rate $\dot{V}$. Actual values (e.g., of tool position $x_t$ and cable tension $F_{cable}$) may in some embodiments be obtained from sensors or other known measurement means. In other embodiments, particularly where a sensor is unavailable or unsuitable, actual values may be estimated by, e.g., one or more observers (examples of which are discussed in greater detail below).

As previously discussed herein, although described in terms of reel angle $\theta$, systems and methods of some embodiments may instead reference and/or output, as relevant to each feature of various embodiments, reel angular velocity, reel torque and/or line speed instead of or in addition to reel angle $\theta$. Thus, for example, methods may include determining a modification to any one or more of reel angular velocity, reel torque, and line speed; and ensuring or otherwise verifying that such determined modifications are actually and/or accurately implemented. In addition, description in terms of fluid flow rate $\dot{V}$ may in some embodiments include pump rate (where the fluid is pumped).

Returning to FIG. 3, the example shown therein includes an implementation, according to some embodiments, of some of the above-discussed features of modifying reel angle $\theta$ and/or fluid flow rate $\dot{V}$, verifying that determined modification(s) are actually implemented, and determining tool position $x_t$ and/or tension $F_{cable}$ that result due, at least in part, to such modification(s). As previously noted, this example embodiment includes reel subsystem 301 and fluid flow subsystem 302, each having inputs cable tension set-point $F_{cable}^*$ and tool position set-point $x_t^*$.

Various features of reel subsystem 301 will first be described. Reel subsystem 301 may include means (e.g., control logic or like feature including any one or more of transfer functions, summation nodes, and inputs) suitable for calculating, determining, and/or generating a desired reel angle modification, which may in some embodiments include a reel control output. A reel control output may in some embodiments include a reel control signal 341 (an example of which, according to some embodiments, is shown in FIG. 3) used to regulate the reel 335, which in turn may affect the tool 34 as already described herein (e.g., by affecting any one or more of cable tension $F_{cable}$ and tool position $x_t$). Regulation of the reel 335 may be accomplished according to any means previously described—for example, by an actuator or like device coupled to the reel 335, or the control signal may be used to display a reel angle value in a manner capable of being monitored or otherwise viewed by a unit operator, thereby enabling the operator to adjust the reel angle accordingly so as to obtain the displayed reel angle value. In other embodiments, the reel control output may be used to regulate the reel 335 by any other suitable means and/or steps.

The reel subsystem 301 of FIG. 3 includes position control 305 and an inner control loop 307. Position control 305 in some embodiments may include means for, and/or steps including, calculating or otherwise determining a desired reel angle (which may, as in FIG. 3, be set-point signal $\theta^*$). In some embodiments, position control 305 may be a position control module capable of calculating or otherwise determining a reel angle set-point $\theta^*$. In the embodiment shown in FIG. 3, position control 305 is based at least in part upon both input $x_t^*$ and input $F_{cable}^*$, as well as input estimated tool position $\hat{x}_t$, resulting from a modification to either or both of reel angle and fluid flow rate. Position control 305 may, in other embodiments, include inputs not shown in FIG. 3 such as, for example: estimated or measured force of friction $F_f$ on the tool 34 (which may result from, e.g., any one or more sources of friction acting on the tool, such as casing, borehole, etc.); rate of reel angle change $\dot{\theta}$; set-point rate of reel angle change $\dot{\theta}^*$; reel angle acceleration; acceleration of the tool 34; and set-point tool acceleration. Rate of reel angle change $\dot{\theta}$ may be measured or estimated; set-point rate of reel angle change $\dot{\theta}^*$ may be a desired or target value for rate of reel angle change calculated, determined, and/or generated based at least in part upon any parameter suitable for determining reel angle set-point $\theta^*$. Position control 305 may, in some embodiments, include calculating a desired reel angle $\theta$ (e.g., set-point signal $\theta^*$) using a mathematical model or relationship similar to and/or derived from any one or more of Equations 6 and 7. A more detailed implementation of position control 305 and related features, in accordance with some embodiments, are discussed elsewhere herein, particularly with reference to FIG. 4.

Returning to FIG. 3, reel subsystem 301 also includes an inner control loop 307. The inner control loop 307 may in some embodiments include means and/or steps for ensuring or otherwise verifying that outputs (e.g., a set-point signal output) from position control 305 are followed by the regulating means (e.g., actuator or, in some embodiments, by a unit operator, or by any other suitable means of regulating the reel 335). It may also include means (such as a modulator) for converting signals from one form to another (for example, for converting a reel angle set-point $\theta^*$ signal to a torque or other input to an actuator or other device for regulating the cable reel 335). For example, inner control loop 307 may include, as shown in FIG. 3, a proportional-integral-derivative (PID) controller 315, a modulator 325 (which may in some embodiments convert a reel angle set-point signal to a torque, voltage, or other signal for input to a modulator coupled to the reel 335), and a feedback loop 343 for reporting the actual reel angle $\theta$ resulting from regulation of the reel 335 (e.g., for use in generating an error signal, which may be used to modify the set-point signal $\theta^*$ at summation node 306). FIG. 3 further depicts the actual physical sub-system under control within inner control loop 307—here, reel 335.

Turning to fluid flow subsystem 302, in some embodiments, the features of fluid flow subsystem 302 may be similar to those of reel subsystem 301, with the difference that fluid flow subsystem 302 may include features and/or steps (e.g., control logic or like feature including any one or more of transfer functions, summation nodes, and inputs) suitable for calculating, determining, and/or generating, as well as regulating and verifying, fluid flow modification rather than reel angle modification. Likewise, calculating, determining, and/or generating fluid flow modification may in some embodiments include a fluid flow control output, which may in some embodiments be a fluid flow control signal 342 (as shown in FIG. 3) used to regulate the fluid flow (e.g., by way of a pump 340, as shown in FIG. 3), which in turn may affect the tool 34 as already described herein. Regulation of the pump 340 or other fluid flow means may be accomplished by, e.g., an actuator or like device coupled to the pump 340 or other fluid flow means, or the fluid flow control signal may be used to display a fluid flow value in a manner capable of being monitored or otherwise viewed by a pump or other fluid flow operator, as previously described herein, such that the operator can adjust fluid flow rate to obtain the displayed fluid flow value. In other embodiments, the fluid flow control output may be used to regulate fluid flow by any other suitable means and/or steps.

The fluid flow subsystem 302 of FIG. 3 includes tension control 310 and an inner control loop 312. Tension control 310 in some embodiments may include means for, and/or steps including, calculating or otherwise determining a desired fluid flow rate suitable for use in regulating or otherwise controlling (including modifying) fluid flow rate $\dot{V}$ such that fluid flow rate $\dot{V}$ becomes or is maintained substantially equal to a desired fluid flow rate $\dot{V}$, or set-point $\dot{V}^*$ (which may, as in FIG. 3, be set-point signal $\dot{V}^*$). In some embodiments, tension control 310 may be a tension control module capable of calculating or otherwise determining a fluid flow rate set-point $\dot{V}^*$, such as set-point signal $\dot{V}^*$ in FIG. 3. In the embodiment shown in FIG. 3, tension control 310 is based at least in part upon both input $x_t^*$ and input $F_{cable}^*$, as well as input cable tension $F_{cable}$ resulting from a modification to either or both of reel angle and fluid flow rate. Tension control 310 may in some embodiments include any input suitable for inclusion as an input to position control 305, discussed previously. Furthermore, tension control 310 may, in some embodiments, include calculating a desired fluid flow rate $\dot{V}$ (e.g., set-point signal $\dot{V}^*$) using a mathematical model or relationship similar to and/or derived from any one or more of Equations 4 and 5. A more detailed implementation of tension control 310 and related features, in accordance with some embodiments, are discussed elsewhere herein, particularly with reference to FIG. 4.

Fluid flow subsystem 302 also includes an inner control loop 312. The inner control loop 312 may in some embodiments include similar means and/or steps as inner control loop 307, except applied to fluid flow rather than reel control. Thus, inner control loop 312 may similarly include verification means that control signals from tension control 310 are followed by the regulating means, and it may also include means (such as a modulator) for signal conversion. For example, inner control loop 312 may include, as shown in FIG. 3, a proportional-integral-derivative (PID) controller 320, a modulator 330, and a feedback loop 344 for reporting the actual fluid flow rate $\dot{V}$ resulting from regulation of the pump 340 (e.g., for use in generating an error signal, which may be used to modify the set-point signal $\dot{V}^*$ at summation node 311). FIG. 3 further depicts the actual physical sub-system under control within inner control loop 312—here, pump 340.

Figure 4:
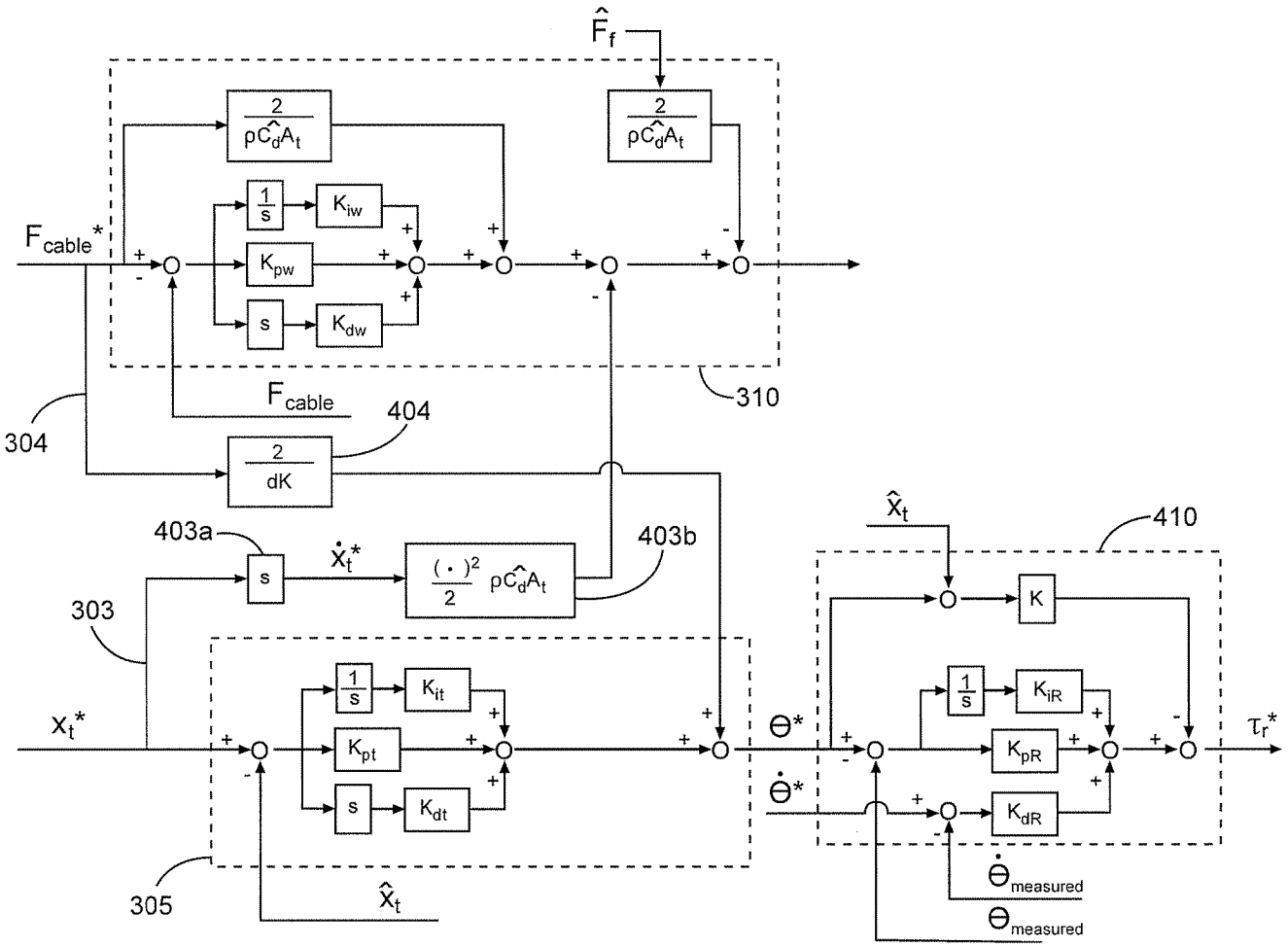
FIG. 4 is a diagram illustrating an example system for generating set-point values, incorporating aspects of the present disclosure.

By way of further example, FIG. 4 is a block diagram showing features of control systems and methods for determining fluid flow rate set-point $\dot{V}^*$) and filtered angle tracking error $\tau_r^*$ according to some embodiments of the present disclosure. It includes an example implementation of position control 305 and tension control 310, each of which includes various transfer functions operating upon input signals and summed according to the block diagram flow and summation nodes shown within position control 305 and tension control 310 in FIG. 4. Position control 305 as shown in the example embodiment in FIG. 4 includes inputs of tool position set-point $x_t^*$, estimated tool position $\hat{x}_t$ (which may be the actual tool position as estimated by, e.g., an observer, as described in greater detail below), and cable tension set-point $F_{cable}^*$, as modified by transfer function 404 at input 304 (as discussed previously with respect to some embodiments). Position control 305 outputs a reel angle set-point $\theta^*$ by operation of the transfer functions of position control 305 on its inputs, as shown in FIG. 4. Tension control 310 in this example embodiment includes inputs of cable tension set-point $F_{cable}^*$, force of friction $F_f$ acting on the tool (shown in FIG. 4 as an estimated force of friction $\hat{F}_f$), and tool position set-point $x_t^*$, as modified by serial transfer functions 403*a* and 403*b* at input 303 (as discussed previously with respect to some embodiments). Tension control 310 outputs a fluid flow rate set-point $\dot{V}^*$ by operation of the transfer functions of tension control 310 on its inputs, as shown in FIG. 4.

In addition, the example embodiment further includes a detailed angle error filter 410 (which may in some embodiments be an implementation of, or otherwise include, any one or more of the summation node 306, PID 315, and modulator 325 of FIG. 3), which may further modify the reel angle set-point $\theta^*$ determined at position control 305 in order to account for errors between expected and actual reel angle $\theta$ and/or reel angle rate $\dot{\theta}$ resulting from regulation of the reel 335, and/or to output a signal (such as a torque signal $\tau_r^*$ as shown in FIG. 4), upon which regulation of the reel may be based, at least in part. It includes inputs of estimated tool position $\hat{x}_t$, reel angle set-point $\theta^*$ (as output by position control 305), reel angle rate set-point $\dot{\theta}^*$ (which may be a desired rate of change of reel angle $\theta$ with respect to time, and may be calculated, determined, or generated based upon any one or more considerations for generating any other set-point discussed herein), measured reel angle $\theta$, and measured reel angle rate $\dot{\theta}$. In some embodiments, a similar error filter (not shown in FIG. 4) could be included in series following the tension control 310, taking as an input fluid flow rate set-point $\dot{V}^*$ and outputting a signal upon which regulation of the pump (or other fluid flow mechanism) may be based, at least in part. The fluid flow rate set-point $\dot{V}^*$ and filtered angle tracking error $\tau_r^*$ shown in FIG. 4 may be used in any manner consistent with various embodiments of this disclosure, including, for example, regulating fluid flow and reel, respectively.

Furthermore, the control systems and methods of some embodiments may optionally include estimation of various actual parameters (such as cable tension $F_{cable}$, force of friction $F_f$, tool position $x_t$, etc.). Such estimation may in some embodiments be performed by an observer 350, as shown for example in FIG. 3. The observer in some embodiments may estimate parameters such as tool position $x_t$ so as to generate, calculate, or otherwise determine an estimated actual parameter (such as estimated tool position $\hat{x}_t$). This generation, calculation, or determination may be based at least in part upon any one or more of various measured values (e.g., parameters measured directly by sensor or other suitable means from the relevant physical subsystem and/or measured as the output of various components of the control system or method). Measured parameters may include, e.g., reel angle θ, cable tension $F_{cable}$, fluid flow rate $\dot{V}$, and reel torque. An observer may, in certain embodiments, include a mathematical model for generation, calculation, or determination of an estimated actual value, such as estimated tool position $\hat{x}_t$. Estimated values may be used in place of measured values wherever such values are useful (e.g., in comparing set-point and actual values as part of verification). For example, the estimated tool position $\hat{x}_t$, may be used as an input to position control 305, as shown in FIG. 3, to determine whether a desired or set-point tool position $x_t^*$ has been obtained. In some embodiments, the observer may be used in and/or referenced as part of a method for verifying a tool position resulting from regulation of either or both of reel and fluid flow. It may instead or in addition be used to determine further modifications to either or both of reel angle and/or fluid flow. In some embodiments, and one or more sensors may instead be used to obtain measured values for use in place of estimated values.

FIG. 5A depicts a block diagram of the functionality of an observer according to some embodiments. The observer 501 of FIG. 5A may be used to estimate tool position and cable tension $F_{cable}$ (e.g., tool position and cable tension resulting from modification to either or both of reel angle θ and fluid flow rate $\dot{V}$). In particular, in this example embodiment it uses inputs of fluid flow rate $\dot{V}$ from pump 340, actual torque applied to the reel $T_r^{in}$ (here shown as being set-point reel torque Tr* signal as modified by torque modulator 510), reel angle θ of the reel 335, and estimated tool weight (including estimated mass $\hat{m}$ as modified according to the well inclination α (wherein α=0° denotes a vertical well, and α=90° denotes a horizontal well)). The inputs are passed through transfer functions, as ordered by the depicted block diagram and summation nodes in FIG. 5A, in a manner approximating a physical model so as to output estimated tool location $\hat{x}_t$, and cable tension $\hat{F}_{cable}$.

FIG. 5B depicts a block diagram of the functionality of an observer according to other embodiments. The observer 550 uses inputs of measured cable tension $F_{cable}$, fluid flow rate $\dot{V}$, and measured reel angle $\theta_{measured}$. The observer 550 of this embodiment does not contain modeling of reel dynamics, but instead uses a model of tool dynamics only, depicted in the flow chart (including PID controller 560 as well as transfer functions and summation nodes) in FIG. 5B. Although specific examples of observers are shown in each of FIGS. 5A and 5B, any observer capable of estimating any one or more actual values, including downhole tool position and cable tension, may be used in various embodiments. In some embodiments, the observer may include a mathematical model and inputs of any one or more measured parameters such as: fluid flow (or pump) rate $\dot{V}$, cable tension $F_{cable}$, reel angle θ, and reel torque Tr. As with other features of the present disclosure, the observer may in some embodiments be included in, and/or its functions may be carried out by, an information handling system, which may include software and/or other executable means implemented on a computer-readable medium, and which may be communicatively coupled to any one or more means of measuring any one or more observer inputs.

Systems and methods of some embodiments may further include estimating force of friction $F_f$ and coefficient of drag $C_d$ for use in various inputs and/or transfer functions consistent with some of the embodiments discussed herein. Estimation may include calibrating frictional forces and drag coefficient for a cabled tool system. In some embodiments, calibration of frictional forces may include operating only the reel system at a time when the tool 34 is in a deviated, horizontal, or substantially horizontal portion of a well, so as to provide measurable parameters (e.g., cable tension $F_{cable}$ and tool weight $F_{weight}$) for determining frictional force $F_f$ acting on the tool as it moves according to reel system modification. This determination in some embodiments may be of an estimated frictional force $\hat{F}_f$. Calibration of the coefficient of drag may include operating only the pump system (while holding the cable reel stationary) when the tool is in a vertical portion of the well (e.g., where frictional forces may be negligible), so as to provide measurable parameters (e.g., cable tension $F_{cable}$ and tool weight $F_{weight}$) for determining the coefficient of drag $C_d$ acting on the tool resulting from fluid flow around the tool. The $C_d$ so calibrated may in some embodiments be as a function of fluid flow rate $\dot{V}$. FIG. 6 depicts a block diagram of an example process of drag coefficient calibration, wherein the reel is held stationary. It includes transfer function 601 (which may enable converting from flow rate to force); saturation block 605; and transfer function 610 (which may enable converting from speed to friction force $F_f$).

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method for controlling a tool in a well, comprising:

determining a desired cable tension of a cable coupled to the tool disposed in a channel and to a reel, wherein determining a desired cable tension comprises determining a cable drag and a cable weight at a time t, wherein the cable drag is based, at least in part, on volumetric flow rate of a fluid flowed downhole over the tool with respect to the time t, tool position with respect to the time t, diameter of the channel, a drag coefficient for flow of the fluid over the tool and cross-sectional area of the tool with respect to a flow direction of the fluid;

determining a rate of fluid flow of the fluid to maintain the desired cable tension based, at least in part, on the desired cable tension, a cable tension set-point and a tool position set-point;

changing a location of the tool in the well using a fluid flow of the fluid at the determined rate of fluid flow; and maintaining the desired cable tension while changing the location of the tool.

2. The method of claim 1 wherein maintaining the desired cable tension comprises controlling the reel.

3. The method of claim 2 wherein controlling the reel comprises sending a control signal to a reel-control device coupled to the reel, and regulating the reel with the reel-control device in response to the reel-control signal.

4. The method of claim 2 wherein maintaining the desired cable tension further comprises controlling a rate of the fluid flow.

5. The method of claim 4 wherein controlling the rate of the fluid flow comprises sending a pump-control signal to a pump-control device coupled to a pump that generates the fluid flow, and regulating the pump with the pump-control device in response to the pump-control signal.

6. The method of claim 1 further comprising determining a desired tool position.

7. The method of claim 6 wherein changing the location of the tool comprises moving the tool to the desired tool position.

8. The method of claim 6 wherein determining a desired tool position comprises:

obtaining a desired tool-position versus time set-point profile; and determining a tool-position set-point from the desired tool-position versus time set-point profile.

9. The method of claim 1, further comprising:

dynamically updating the desired cable tension to be maintained.

10. A method for controlling a tool in a well, comprising:

generating a fluid flow around the tool disposed in a channel at a first flow rate, wherein the tool is coupled to a reel by a cable;

maintaining the reel at a first reel angle;

determining a cable tension set-point;

determining a tool position set-point;

based at least in part on the cable tension set-point and the tool position set-point, determining a reel angle set-point;

based at least in part on the cable tension set-point and the tool position set-point, determining a flow rate set-point; and wherein generating the fluid flow is based, at least in part, on a desired cable tension, the reel angle set-point and the flow-rate set-point, wherein the desired cable tension is determined based, at least in part, on a cable drag and a cable weight at a time t, wherein the cable drag is based, at least in part, on volumetric flow rate of a fluid downhole over the tool with respect to the time t, tool position with respect to the time t, diameter of the channel, a drag coefficient for flow of the fluid over the tool and cross-sectional area of the tool with respect to a flow direction of the fluid.

11. The method of claim 10 further comprising maintaining tension in the cable substantially equal to the cable tension set-point while maintaining the tool at a position substantially equal to the tool position set-point.

12. The method of claim 11 wherein the cable tension set-point is determined such that it does not vary with respect to time.

13. The method of claim 12 wherein the tool position set-point is determined such that it varies with respect to time.

14. The method of claim 10 further comprising:

determining a second flow rate different from the first flow rate, based at least in part upon the flow rate set-point;

changing the first flow rate to the second flow rate for the fluid flow;

determining a second reel angle different from the first reel angle, based at least in part upon the reel angle set-point; and maintaining the reel at the second reel angle.

15. The method of claim 14 further comprising:

comparing the second flow rate with the flow rate set-point; and comparing the second reel angle with the reel angle set-point.

16. The method of claim 14 further comprising:

measuring tension in the cable after pumping the fluid around the tool at the second pump rate, so as to obtain a cable tension measurement;

estimating tool position using an observer after pumping the fluid around the tool at the second pump rate, so as to obtain a tool position estimate;

determining a second reel angle set-point based at least in part upon the cable tension measurement and the tool position estimate; and determining a second pump rate set-point based at least in part upon the cable tension measurement and the tool position estimate.

17. The method of claim 10 wherein the cable comprises a wireline.

18. The method of claim 10 wherein the cable comprises a slickline.

19. A system comprising:

a tool disposed in a channel of a well;

a reel coupled to the tool by a cable;

a pump capable of pumping a fluid around the tool;

a reel actuator coupled to the reel;

a pump actuator coupled to the pump;

a control system communicatively coupled to the reel actuator and the pump actuator, wherein the control system comprises at least one processing resource, an interface unit capable of transmitting a reel control signal and a fluid flow control signal, and a computer-readable medium comprising executable instructions that, when executed, cause the at least one processing resource to receive a cable tension set-point signal and a tool position set-point signal, calculate, based at least in part upon the cable tension set-point signal and the tool position set-point signal, a reel angle set-point and a fluid flow rate set-point, generate the reel control signal, based at least in part upon the reel angle set-point, and generate the fluid flow control signal, based at least in part upon a desired cable tension, the reel angle set-point and the fluid flow rate set-point, wherein the desired cable tension is determined based, at least in part, on a cable drag and a cable weight at a time t, wherein the cable drag is based, at least in part, on volumetric flow rate of the fluid downhole over the tool with respect to the time t, tool position with respect to the time t, diameter of the channel, a drag coefficient for flow of the fluid over the tool and cross-sectional area of the tool with respect to a flow direction of the fluid.

20. The system of claim 19 further comprising a display.

21. The system of claim 20 wherein the interface unit is capable of (i) transmitting the reel control signal to any one or more of the reel actuator and the display, and (ii) transmitting the fluid flow control signal to any one or more of the pump actuator and the display; and wherein the computer-readable media further comprises executable instructions that, when executed, cause the at least one processing resource to send the reel control signal to any one or more of the reel actuator and the display; and send the fluid flow control signal to any one or more of the pump actuator and the display.

22. The system of claim 20 wherein the observer comprises a physical model capable of predicting any one or more of tool location and cable tension, based at least in part upon measured fluid flow rate, measured reel torque, and measured reel angle.

23. The system of claim 20 wherein the observer comprises a model of tool dynamics capable of predicting tool location based at least in part upon measured fluid flow rate, measured cable tension, and measured reel angle.

24. The system of claim 19 wherein the interface unit is capable of transmitting the reel control signal to the reel actuator and (ii) the fluid flow control signal to the pump actuator; and wherein the computer-readable medium further comprises executable instructions that, when executed, cause the at least one processing resource to send the reel control signal to the reel actuator, and send the fluid flow control signal to the pump actuator.

25. The system of claim 19 further comprising an observer communicatively coupled to the control system.

26. The system of claim 19 wherein the reel actuator is regulated automatically based at least in part upon the reel control signal.

27. The system of claim 19 wherein the pump actuator is regulated automatically based at least in part upon the fluid flow control signal.

* * * * *